US005321794A

United States Patent [19]

Tamura

[11] Patent Number: 5,321,794

[45] Date of Patent: Jun. 14, 1994

[54] VOICE SYNTHESIZING APPARATUS AND METHOD AND APPARATUS AND METHOD USED AS PART OF A VOICE SYNTHESIZING APPARATUS AND METHOD

[75] Inventor: Junichi Tamura, Tokyo, Japan

[73] Assignee: Canon Kabushiki Kaisha, Tokyo, Japan

[21] Appl. No.: 904,906

[22] Filed: Jun. 25, 1992

Related U.S. Application Data

[63] Continuation of Ser. No. 470,774, Jan. 26, 1990, abandoned.

[30] Foreign Application Priority Data

Jan. 1, 1989 [JP] Japan ..... 1-19853

[51] Int. Cl.[5] ..... G10L 9/02

[52] U.S. Cl. ..... 395/269

[58] Field of Search ..... 381/51-53; 395/2.69; 84/622-625, 659-661, DIG. 9

[56] References Cited

U.S. PATENT DOCUMENTS

| | | | |
|---|---|---|---|
| 3,704,345 | 11/1972 | Coker | 381/52 |
| 4,236,434 | 12/1980 | Nishibe | 84/DIG. 9 |
| 4,527,274 | 7/1985 | Gaynor | 381/51 |
| 4,542,524 | 8/1985 | Laine | 381/53 |
| 4,613,985 | 9/1986 | Hashimoto et al. | 381/51 |
| 4,692,941 | 8/1987 | Jacks | 381/52 |
| 5,056,145 | 10/1991 | Yamamoto et al. | 381/51 |

FOREIGN PATENT DOCUMENTS 0017341 10/1980 European Pat. Off. .

0144724 6/1985 European Pat. Off. .

OTHER PUBLICATIONS

"The Use of Linear Prediction of Speech In Computer Music Applications", Journal of the Audio Engineering Society, J. Moorer, vol. 27, No. 3, Mar. 1979, pp. 134-140, New York.

"High Quality Parcor Speech Synthesizer", IEEE Transactions on Consumer Electronics, T. Sampei, et al., vol. CE-26, No. 3, Aug. 1980, pp. 353-358.

"An Integrated Speech Synthesizer", IEEE Journal of Solid-State Circuits, M. Martin, et al., vol. SC-16, No. 3, Jun. 1981, pp. 163-168.

*Primary Examiner*—Michael R. Fleming
*Assistant Examiner*—Michelle Doerrler
*Attorney, Agent, or Firm*—Fitzpatrick, Cella, Harper & Scinto

[57] ABSTRACT

A voice synthesizing apparatus is arranged to synthesize a voice from text data composed of either character codes or a series of symbols by generating a sound source based on a series of sound-source parameters and synthesizing the sound source on the basis of a series of synthesis parameters. The voice synthesizing apparatus is provided with a sound-source generating circuit for generating the aforesaid sound source from a signal obtained from an instrumental sound generated with a musical instrument. This arrangement serves to easily synthesize voices which convey language information and yet which simulate the sounds of musical instruments such as a guitar, a violin, a harmonica, a musical synthesizer and the like.

32 Claims, 10 Drawing Sheets

VOICE SYNTHESIZING APPARATUS AND METHOD AND APPARATUS AND METHOD USED AS PART OF A VOICE SYNTHESIZING APPARATUS AND METHOD

This application is a continuation of application Ser. No. 470,774 filed Jan. 26, 1990 which is now abandoned.

BACKGROUND OF THE INVENTION

1. Field of the Invention

The present invention relates generally to a voice synthesizing apparatus and, more particularly, to a voice synthesizing apparatus for generating voice waveforms which simulate the tone colors of musical instruments.

2. Description of the Related Art

The basic construction of a typical voice synthesizing apparatus is explained below with reference to FIG. 3. Text data, which is received by a text data input section 1, is supplied to a text analyzing section 2. The text analyzing section 2 analyzes the input text data to extract information on various factors such as words, blocks, breaks and the beginning and end of each sentence contained in the text data. A phonetic-symbol generating section 3 converts a series of characters, which are organized into words and blocks, into a series of phonetic symbols, while a rhythmic-symbol generating section 4 generates the required rhythmic symbols by utilizing, e.g., an accent dictionary and accent rules about the words and the blocks. A synthesis-parameter generating section 5 generates a time series of synthesis parameters by interpolating individual parameters corresponding to the above series of phonetic symbols.

A sound-source parameter generating section 6 generates a time series of sound-source parameters concerning rhythmic information on pitch, accent, sound volume and the like and supplies it to a sound-source section 7. If the supplied parameters represent a voiced sound, the sound-source section 7 generates pulses and supplies them to a voice synthesizing section 8. In the case of an unvoiced sound, the sound-source section 7 generates white noise or the like and supplies it to the voice synthesizing section 8. Upon receiving the synthesis-parameter output from the synthesis-parameter generating section 5, the voice synthesizing section 8 generates a voice by utilizing the output from the sound-source section 7 as a drive sound source. Since the sound-source section 7 and the voice synthesizing section 8 receive the sound-source parameters and the synthesis parameters, respectively, to generate a voice, they are hereinafter collectively referred to as a synthesizing section 9.

The synthesizing section 9 of the conventional voice synthesizer described above will be explained below in greater detail. FIG. 4 is a detailed block diagram showing the synthesizing section 9. For the sake of simplicity of explanation, it is assumed that a phonetic-parameter storing memory 14 stores the synthesis and sound-source parameters in the form of one block (frame) and the series of phonetic symbols in the form of one block (frame). The conventional voice synthesizer is provided with a pulse generator 10 as a voiced-sound source and a white-noise generator 11 as an unvoiced-sound source. In particular, since the pulse generator 10 as the voiced-sound source utilizes impulses, triangular waves or the like, the voice synthesized by the pulse generator 10 tends to sound mechanical. If a driver circuit of the type which utilizes residual waveforms (or output waveforms obtained from an input accoustic sound through the inverse filter of a synthesizing filter) is substituted for the pulse generator 10, various voices can be synthesized with improved quality.

A V/U switching section 12 is provided for effecting switching between the synthesization of a voiced sound and the synthesization of an unvoiced sound. If a fricative sound needs to be synthesized, the V/U switching section 12 provides a mixed output of the output from the pulse generator 10 and the output from the white noise generator 11 with an appropriately varied mixing ratio. An amplitude control section 13 controls sound volume which is one of sound-source patterns. A voice synthesizing filter 17 receives the synthesis parameters (representing phonetic features) and operates in response to the signal output from the amplitude control section 13 by utilizing such parameters as filter factors, thereby generating voice waveforms. Normally, voice synthesization is performed by a digital filter and the voice synthesizing filter 17 is therefore followed by a D/A converter. A low-pass filter 18 cuts a foldover frequency component, and a voice, amplified by an amplifier 19, is output from a loudspeaker 20. A parameter transfer control section 15 transfers the required data to each of the modules described above. A clock generator 16 serves to determine the timing of parameter transfer and a sampling interval for the system.

As described above, the conventional arrangement utilizes impulses, triangular waves, residual waveforms and the like as the source of a voiced sound. Accordingly, such conventional arrangements cannot be used to synthesize voices which simulate the tone colors of musical instruments. With such a conventional arrangement, it has therefore been difficult to vary the quality of the reproduced voice while maintaining phonetic the features thereof. However, an apparatus capable of outputting an instrumental sound or the like in the form of clear voice information has not yet been proposed.

SUMMARY OF THE INVENTION

It is therefore an object of the present invention to provide a voice synthesizing apparatus which is capable of easily synthesizing voices which convey language information and yet which simulate the sounds of musical instruments such as a guitar, a violin, a harmonica, a musical synthesizer and the like.

To solve the above-described problems, in accordance with the present invention, there is provided an improvement in a voice synthesizing apparatus for synthesizing a voice from text data composed of one of character codes and a series of symbols by generating a sound source based on a series of sound-source parameters and synthesizing the sound source on the basis of a series of synthesis parameters. The improvement comprises sound-source generating means for generating the sound source from a signal obtained from an instrumental sound generated with a musical instrument.

The sound-source generating means may have a plurality of kinds of sampled data obtained by sampling a waveform of at least one period from at least one kind of instrumental-sound waveform.

The above plurality of kinds of sampled data stored in units of periods may be stored in memory in a state with the amplitude power of each of the sampled data normalized in accordance with the input of a voice synthesizing filter.

The plurality of kinds of sampled data stored in units of periods may be stored in memory in bit-compressed form.

Also, the sound-source generating means may be provided with a plurality of instrumental-sound generators and mixing means for summing outputs from the respective instrumental-synthesizer sound generators on the basis of information representing a mixing ratio.

In accordance with the present invention, it is possible to provide a voice synthesizing apparatus capable of easily synthesizing voices which convey language information and yet which simulate the sounds of musical instruments such as a guitar, a violin, a harmonica, a musical synthesizer and the like.

Further objects, features and advantages of the present invention will become apparent from the following detailed description of preferred embodiments of the present invention with reference to the accompanying drawings.

DESCRIPTION OF THE PREFERRED EMBODIMENTS

Preferred embodiments of the present invention will be explained below with reference to the accompanying drawings. In the present specification, the term "musical instrument" is defined as a concept which embraces not only musical instruments such as brass instruments, woodwind instruments or electronic instruments, but also anything that can make a sound, for example, stones, water or glasses.

Figure 1:
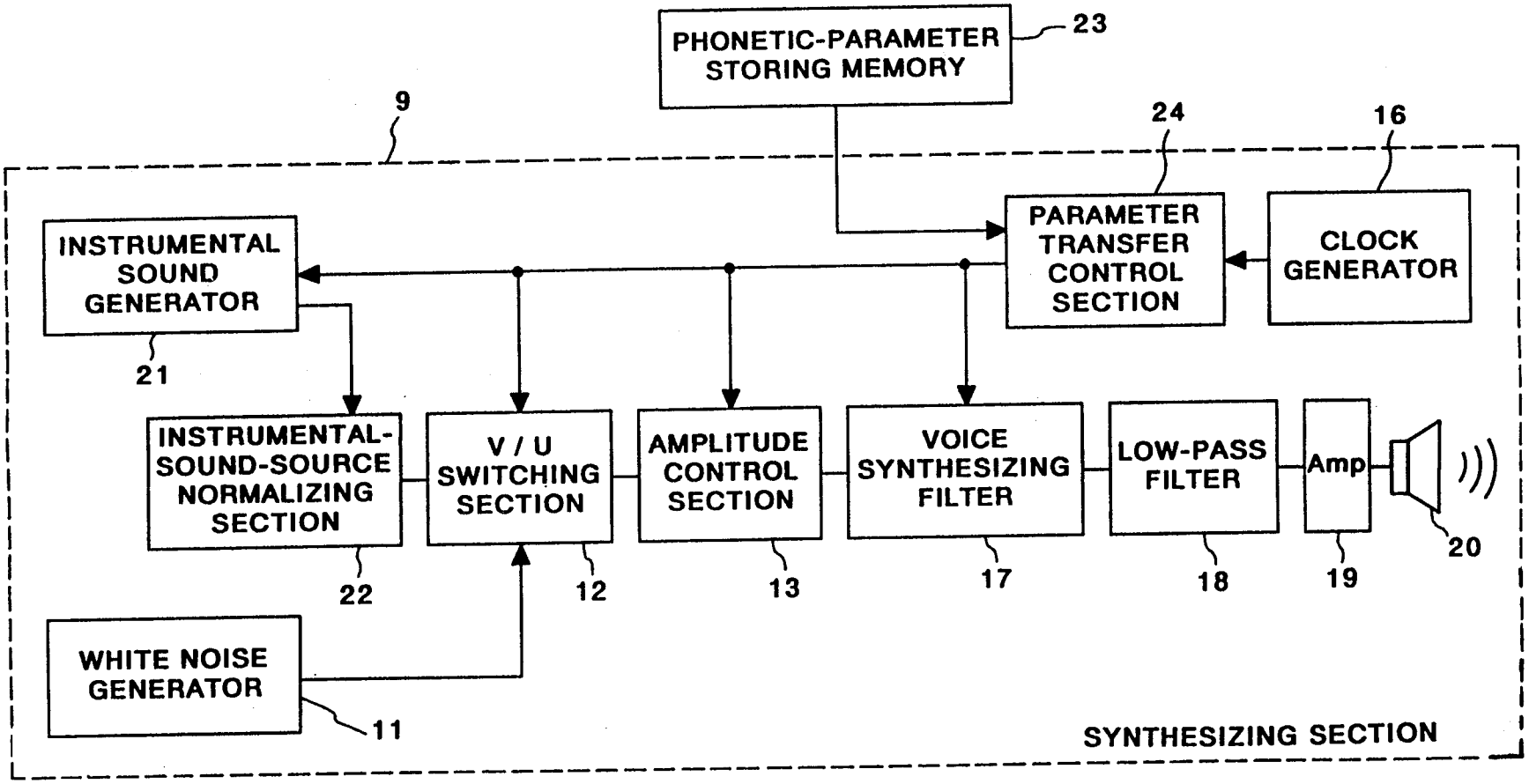
FIG. 1 is a block diagram showing the synthesizing section of an embodiment of a voice synthesizing apparatus according present invention.
Figure 3:
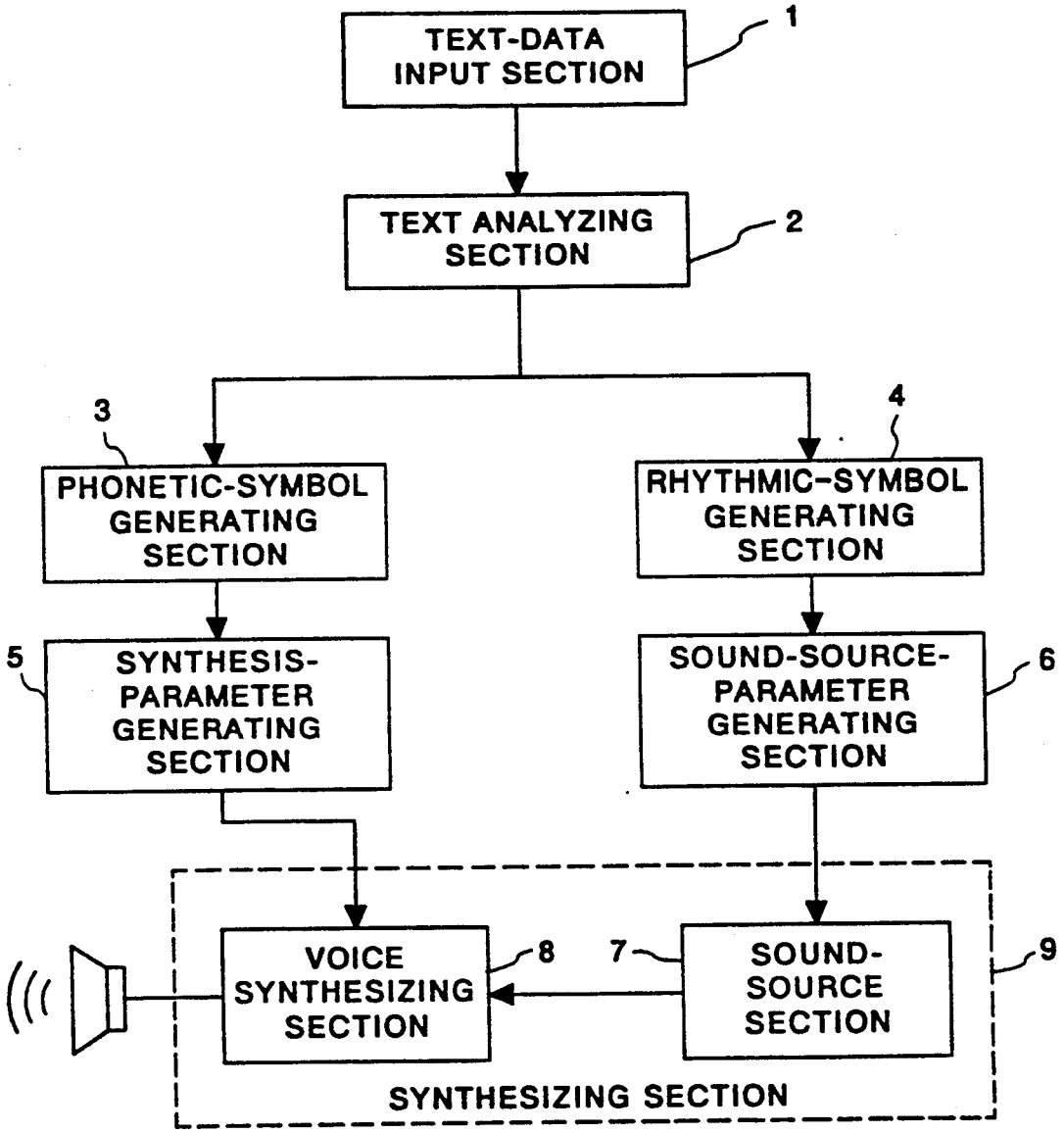
FIG. 3 is a basic block diagram of the voice synthesizing apparatus.
Figure 4:
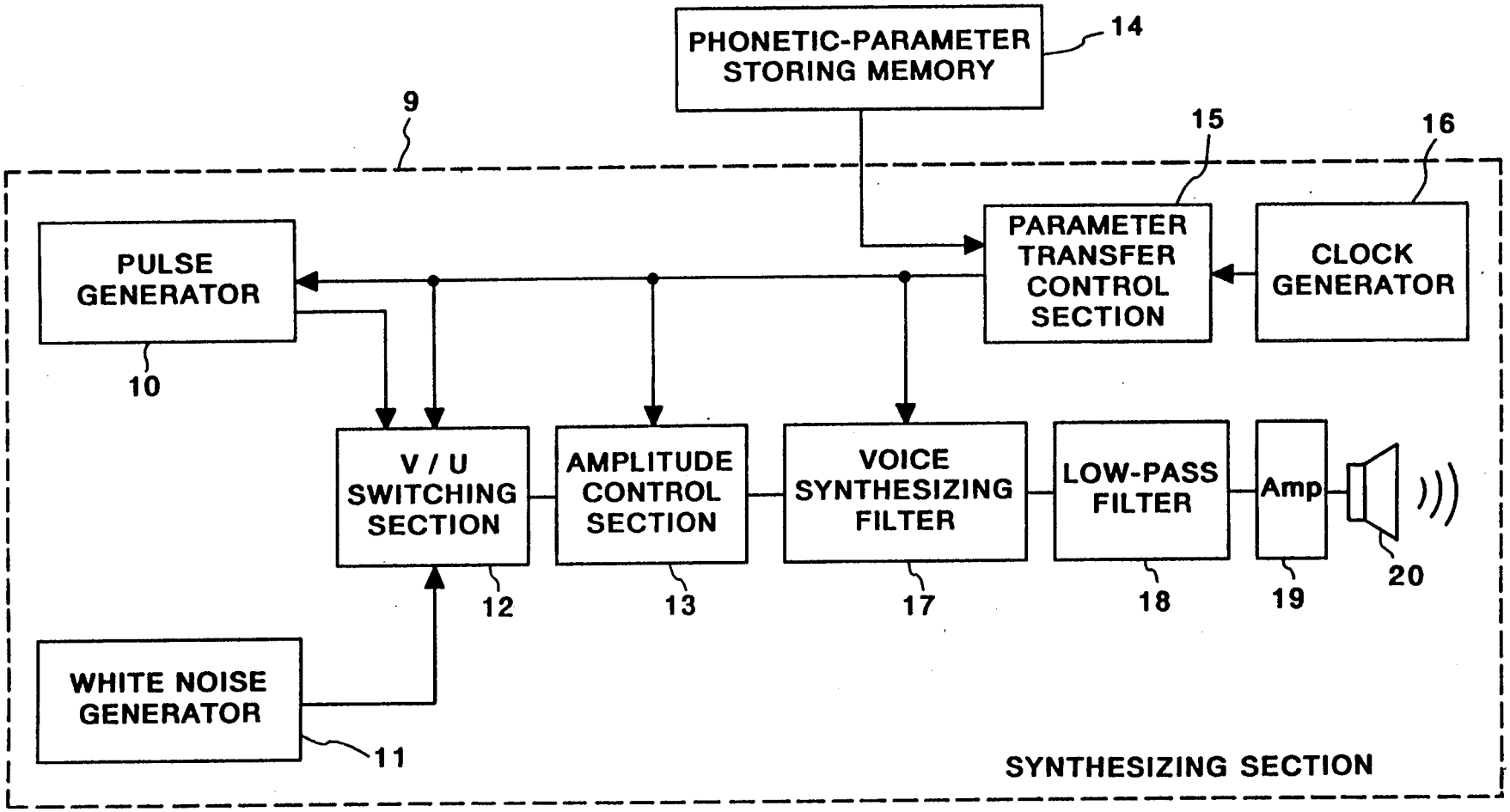
FIG. 4 (PRIOR ART)
FIG. 4 is a block diagram showing the synthesizing section of a conventional type of voice synthesizing apparatus.

FIG. 1 is a block diagram showing the construction of the synthesizing section of one embodiment of a voice synthesizing apparatus according to the present invention. An instrumental-sound generator 21 outputs the periodic waveforms of various instrumental sounds. The output level of each instrumental sound depends on the kind of corresponding musical instrument. To normalize the power level of each instrumental sound generated by the instrumental-sound generator 21, the instrumental-sound normalizing section 22 controls the amplitude of the generated instrumental sound so that the input power level may be kept constant. A phonetic-parameter storing memory 23 stores musical-instrument selecting information for selecting the kind of musical instrument in addition to conventional sound-source parameters. A parameter transfer control section 24 transfers the musical-instrument selecting information to the instrumental-sound generator 21. Each module indicated by the same reference numerals as those shown in FIG. 4 are substantially the same as those used in the conventional arrangement. If the synthesizing section of FIG. 1 is substituted for the synthesizing section of FIG. 3, the above-described embodiment of the voice synthesizing apparatus capable of synthesizing various instrumental sounds can be obtained.

Figure 2:
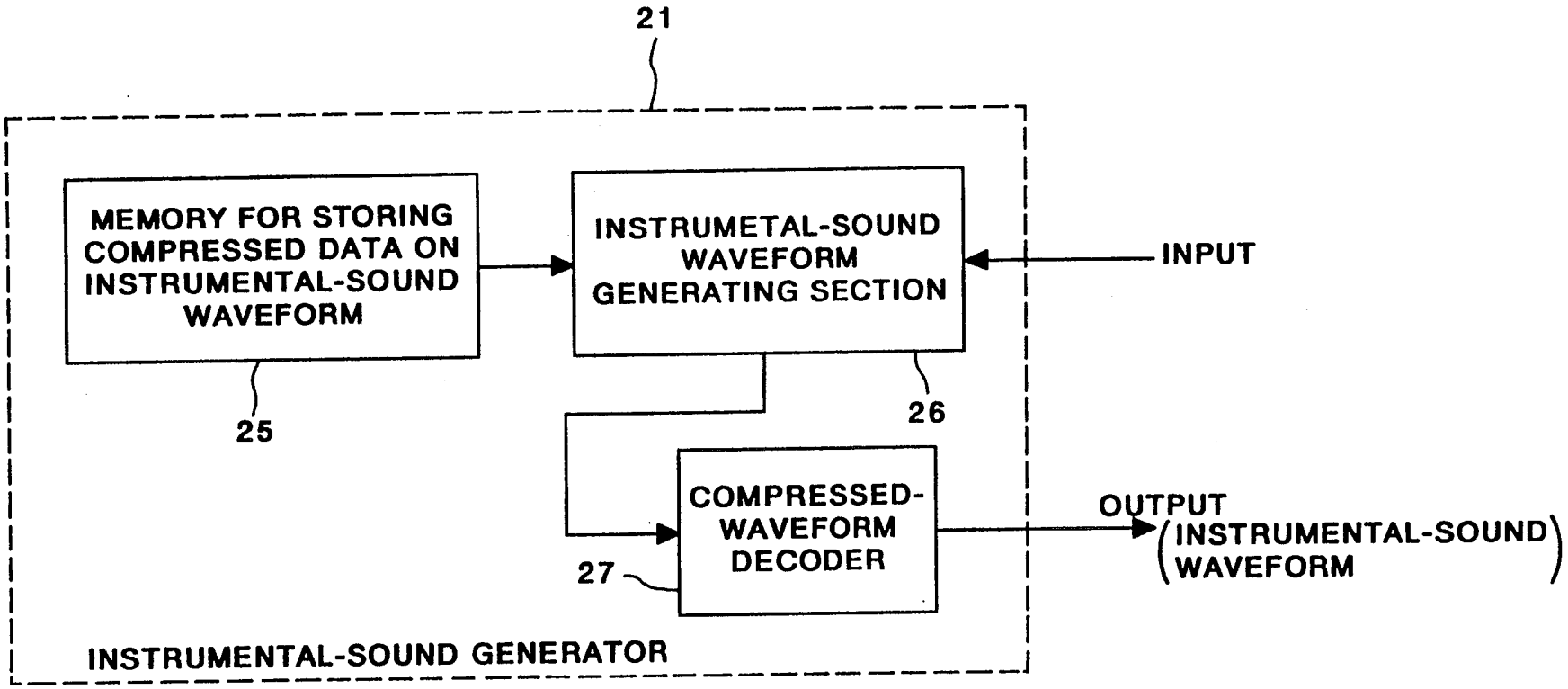
FIG. 2 is a block diagram showing the construction of the instrumental-sound generator of the embodiment of the voice synthesizing apparatus according to the present invention.

The construction of the instrumental-sound generator 21 will be described below in greater detail with reference to FIG. 2. A memory 25 for storing compressed data on instrumental-sound waveforms stores the waveform of each instrumental sound of one period or more in compressed and encoded form. Since various kinds of instrumental sounds are stored for various kinds of pitch frequencies, waveform-referencing tables, such as offset tables, are also stored in the memory 25. An instrumental-sound waveform generating section 26 compiles instrumental-sound waveform data corresponding to input information on the basis of pitch information and the kind of selected musical instrument, and transfers the instrumental-sound waveform data thus obtained to a compressed-waveform decoder 27. The decoded instrumental waveform is output from the compressed-waveform decoder 27.

Figure 5:
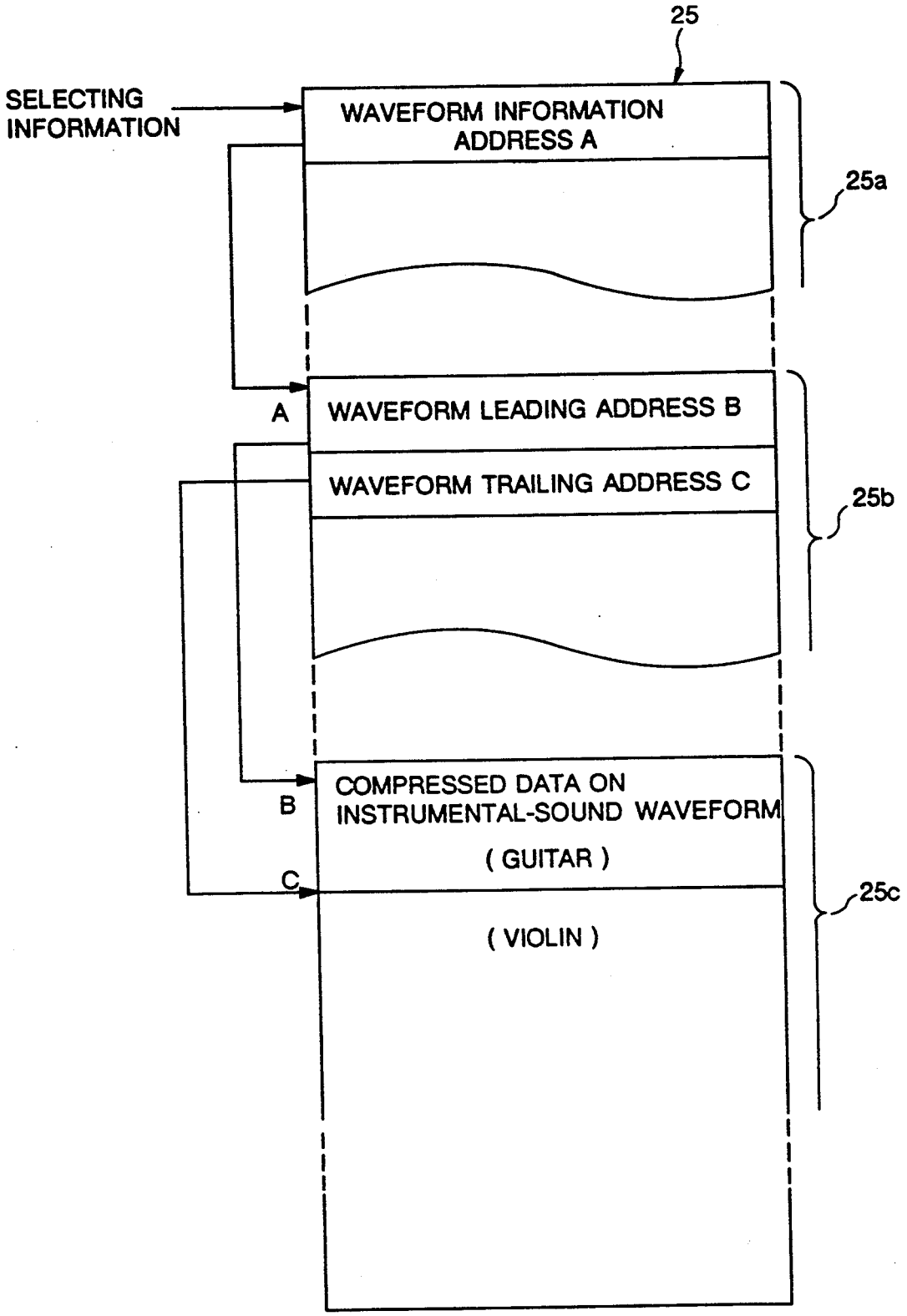
FIG. 5 is a schematic view showing the internal construction of a memory for storing compressed data on instrumental-sound waveforms.

FIG. 5 shows the memory map in the memory 25 for storing compressed data on musical instruments. The parameter transfer control section 24 transfers musical-instrument selecting information for selecting the pitch and the kind of musical instrument. If, for instance, this selecting information is represented with 8 bits (1 byte), and the higher-order 6 bits and the lower-order 2 bits are respectively used as pitch information and information representing the kind of selected instrumental sound, it will be possible to select an instrumental-sound waveform from among combinations of four kinds of instrumental sounds and sixty-four steps of pitch; that is to say, one of the offset tables **25*a* can be selected on the basis of the selecting information. The offset table 25*a* stores addresses indicating the memory locations in a waveform-information storing section 25*b* which stores the leading and trailing addresses of waveform data. The two addresses of the waveform-information storing section 25*b* indicate compressed data on the waveform of each musical instrument of one period. The compressed data are stored in the compressed data area 25*c***.

Figure 6:
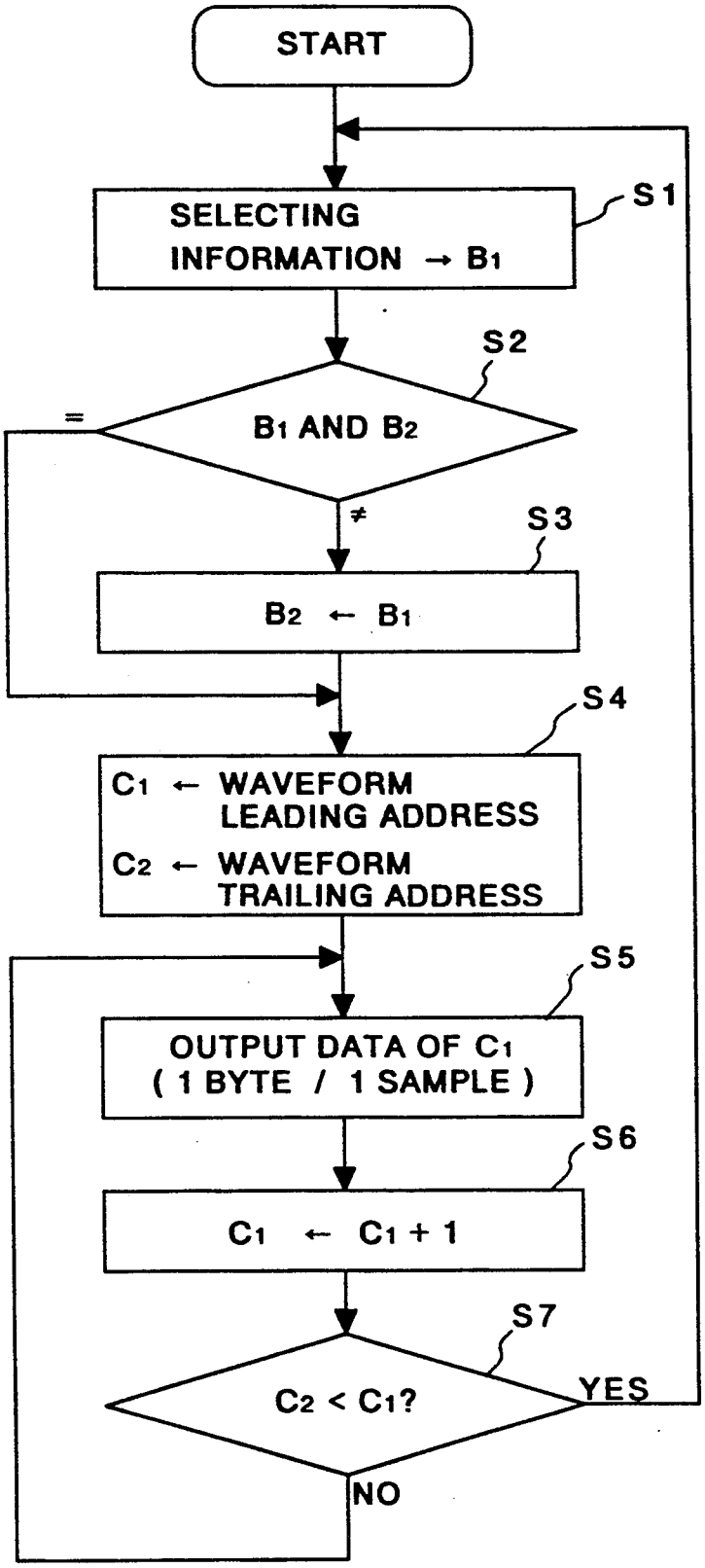
FIG. 6 is a flow chart showing the process executed in the interior of an instrumental-sound waveform generating section.

The processing, executed by the sound-source parameter generating section 6 when the musical-instrument selecting information of one byte is input, is explained below with reference to the flow chart of FIG. 6. In Step S1, the musical-instrument selecting information of one byte is first input into a buffer $B_1$ and is held in a buffer $B_2$ until the next information is input. In Step S2, the current musical-instrument selecting information is compared with the preceding musical-instrument selecting information. If they are the same, the process returns to the state of waiting for the next musical-instrument selecting information to be input. (However, in the first cycle, Step S2 is passed for "NO".) If the current musical-instrument selecting information differs from the preceding musical-instrument selecting information, the process proceeds to Step S3, where the new value is stored in the buffer $B_2$ and, in Step S4, a waveform leading address B and a waveform trailing address C are stored in counters $C_1$ and $C_2$, respectively. In Step S4, the data indicated by the counter $C_1$ is transferred to a compressed-waveform decoder 27. In this explanation, data for one sample is assumed to be represented by one byte. Then, in Step S5, the value of the counter $C_1$ is incremented by one and one piece of waveform data (having a length of an integral multiple of one period) is transferred. Then, in Step S6, the values of the counters $C_1$ and $C_2$ are compared with each other. If the value of the counter $C_1$ is equal to or less than $C_2$, Steps S4–S6 are repeated.

If the value of the counter $C_1$ is greater than $C_2$, the process returns to Step S1, where the next musical-instrument selecting information is input into the buffer $B_1$. Then, in Step $S_2$, the values of the buffers $B_1$ and $B_2$ are compared. If they are the same, the waveform data of the same portion is again transferred to the compressed-data decoder 27. If they are different, the process proceeds to Step S3, where the new musical-instrument selecting information of the buffer $B_1$ is stored in the buffer $B_2$. Thereafter, in Step S4, the leading address B' and the trailing address C' of a region in which different waveform data is stored, are stored in the counters $C_1$ and $C_2$, respectively, and transfer of a periodic waveform is continued. The intervals of this waveform transfer normally correspond to sampling intervals.

Although there are numerous methods of compressing waveform data such as ADPCM, ADM and the like, the data encoding system and the decoding system of the compressed data decoder 27 need be made to correspond to each other.

Figure 7:
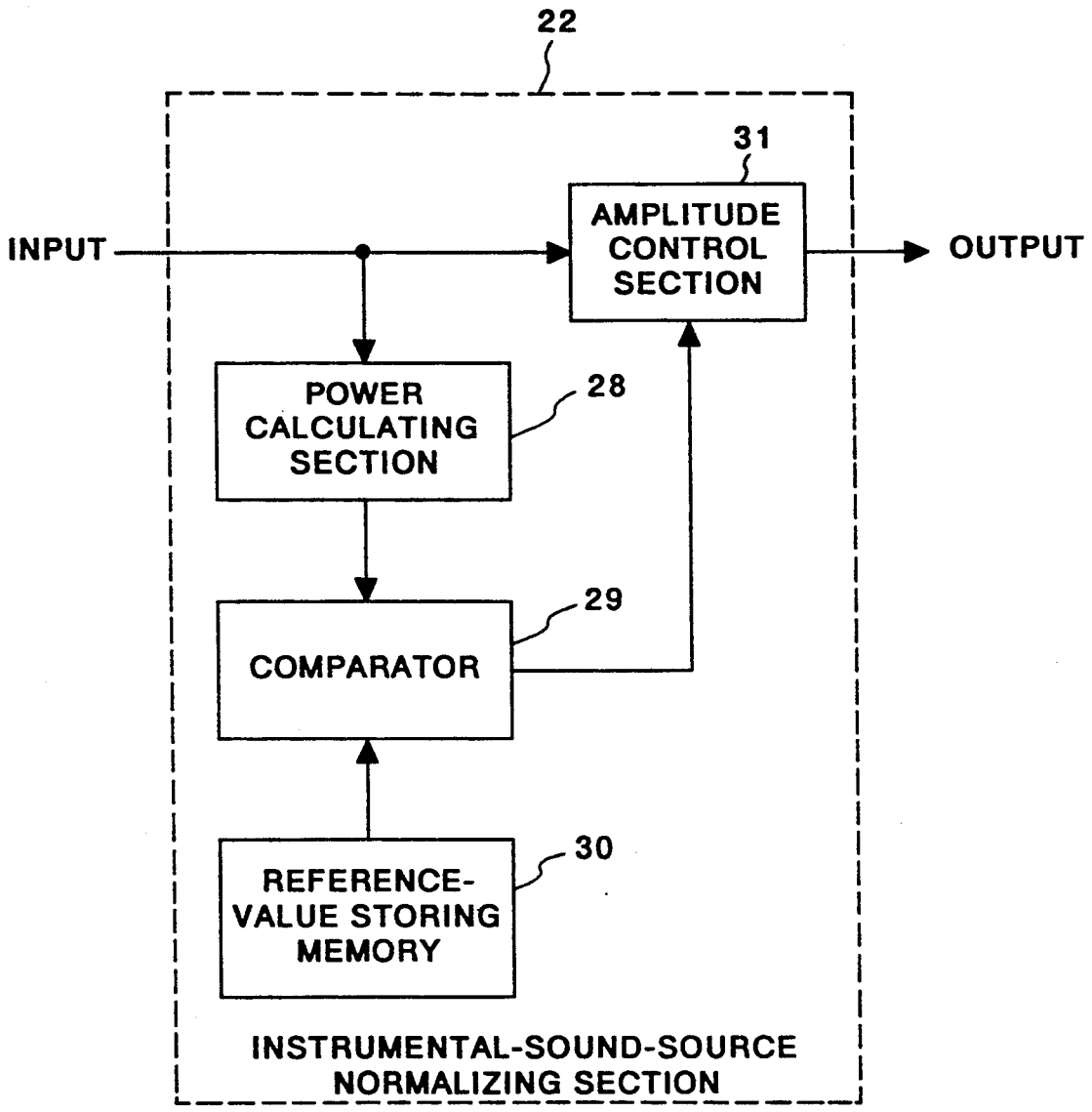
FIG. 7 is a block diagram showing the instrumental-sound-source normalizing section used in the embodiment of the voice synthesizing apparatus according to the present invention.
Figure 8:
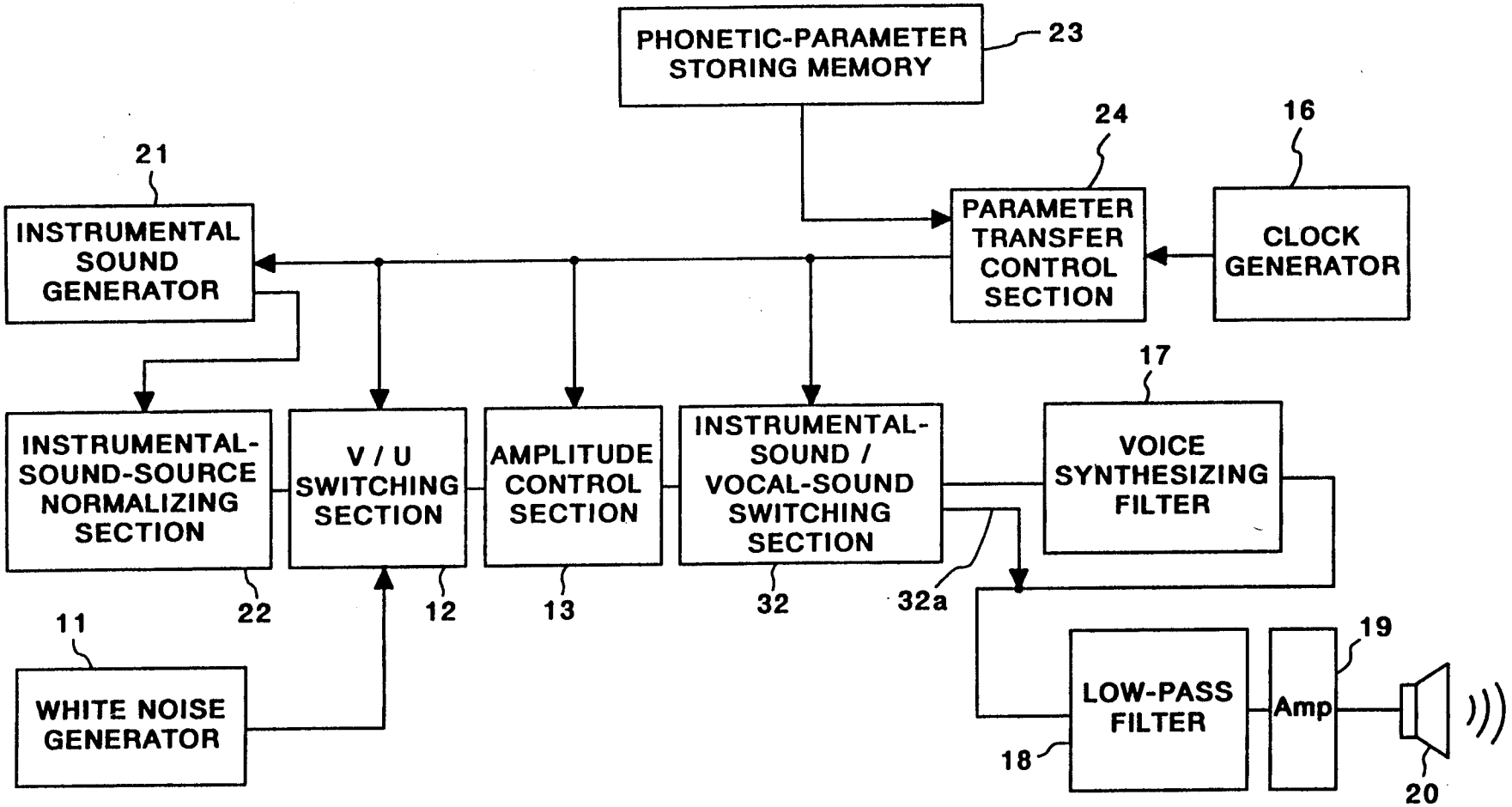
FIG. 8 is a block diagram showing the construction of another embodiment provided with an instrumental-sound/vocal-sound switching section.

FIG. 7 shows the construction of the instrumental-sound normalizing section 22. The instrumental-sound-source normalizing section 22 includes a power calculating section 28 for calculating the power of the input instrumental-sound waveform, a comparator 29, a reference-value storing memory 30 which stores reference values for normalization, and an amplitude control section 31. The comparator 29 compares the value of the power calculating section 28 with the value of the reference-value storing memory 30 and, on the basis of the difference thus obtained, the amplitude control section 31 controls the amplitude of the input instrumental-sound waveform. The instrumental-sound normalizing section 22 is needed when the instrumental sound input through a microphone or the like is directly and in real time used as the sound source of the voice synthesizing apparatus. However, if the normalized power of the waveform of each instrumental sound is stored in memory, the instrumental-sound normalizing section 22 is not needed solely when the instrumental sound pattern in memory is utilized.

Figure 9:
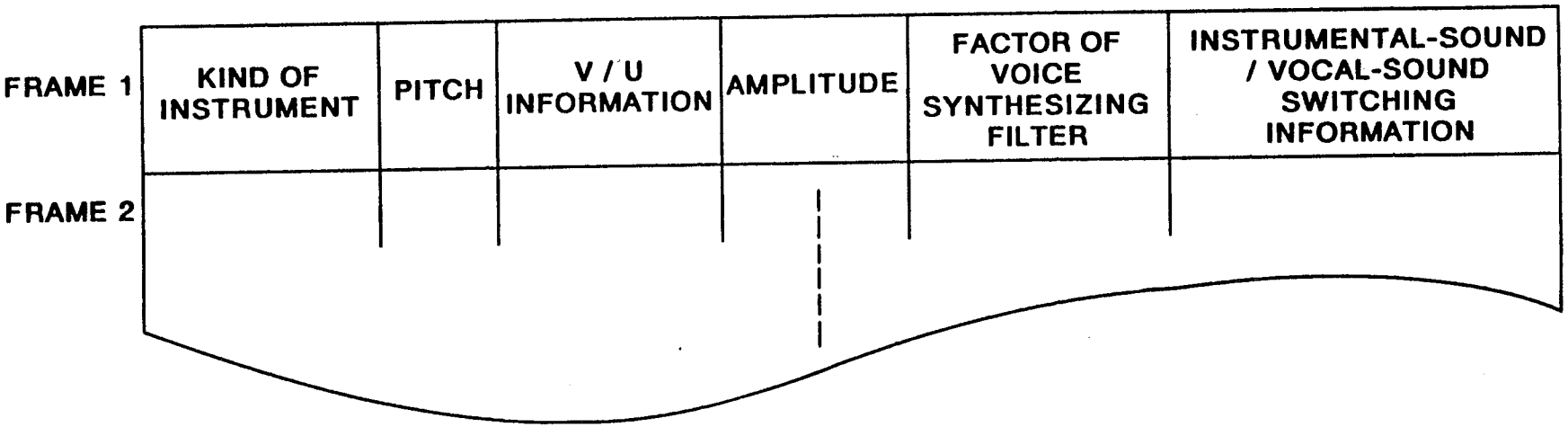
FIG. 9 is a view showing the arrangement of various parameters in one frame according to the embodiment of FIG. 8.

The above-described embodiment of the voice synthesizing apparatus is provided with the instrumental-sound generator as the sound source for instrumental sounds. In addition, if an instrumental-sound/vocal-sound switching section 32 and a path 32*a* which bypasses the voice synthesizing filter are added to the above arrangement, the present voice synthesizing apparatus will be able to output the waveform output of a mixed waveform consisting of the voice synthesizer output and the instrumental-sound generator output. In this case, the arrangement of parameters stored in the phonetic-parameter storing memory 23 is as shown in FIG. 9.

Figure 10:
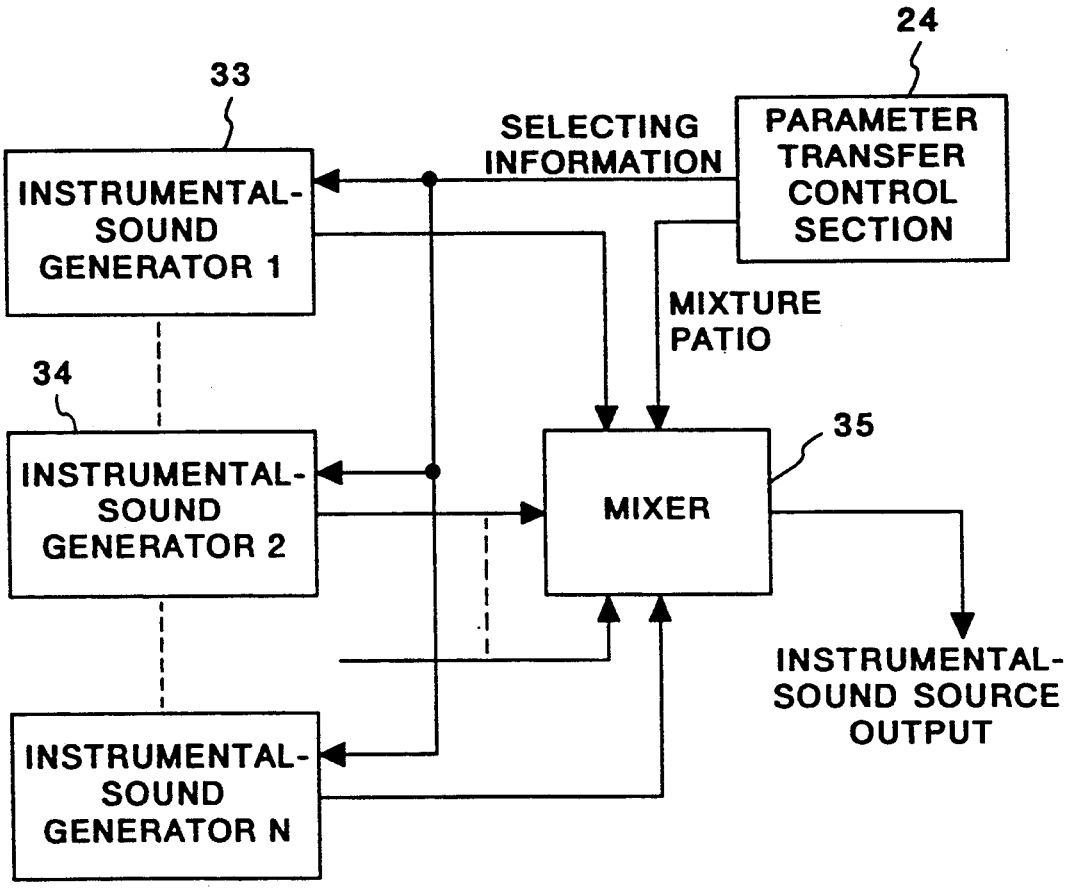
FIG. 10 is a block diagram showing another embodiment provided with a plurality of instrumental-sound generators.

Alternatively, as shown in FIG. 10, a plurality of instrumental-sound generators 33, 34, . . . each having the same construction as the instrumental-sound generator 21, as well as a mixer 35 may be provided. In this arrangement, a plurality of waveforms based on the pitch and the kind of instrumental sound given by the phonetic-parameter storing memory 23 are output from the mixer 35 in mixed form. This arrangement makes it possible to utilize, as its sound source, not only the sound of a single musical instrument but also the sum of the sounds of a plurality of musical instruments.

As is apparent from the foregoing, in accordance with the above-described embodiments, an instrumental-sound source corresponding to input phonetic information can be selected and a voice can be synthesized from the selected instrumental sound source. Accordingly, it is possible to synthesize a voice representing language information with the tone color of the sound of one or more kinds of musical instruments. Moreover, in the case of particular kinds of instrumental sounds, the quality of the synthesized voice can be further improved, and a voice, which is close to an ordinary voice, can also be synthesized. Further, the language information (phonetic information) and pitch (scale) of a tone color can be varied, whereby, for example, "good afternoon, everybody" can be synthesized with the tone color of a guitar. Accordingly, it is possible to provide a voice synthesizing apparatus having the function of outputting a voice having an instrumental sound, which function is not incorporated in conventional types of voice synthesizing apparatus. If an appropriate sound source is employed as an instrumental-sound source, it is possible to easily vary the voice quality of the synthesized voice. In addition, it is possible to provide a high-quality voice synthesizing apparatus which is capable of reproducing the oscillation, depth (mellowness) or the like of a voice.

Moreover, if a path which bypasses the voice synthesizing filter is provided, it is possible not only to output the voice of an instrumental sound, but also to alternately output the synthesized voice and an instrumental sound, or to output an instrumental sound alone.

The present invention is not limited to the above embodiments and various changes and modifications can be made within the spirit and scope of the present invention. Therefore, to apprise the public of the scope of the present invention the following claims are provided.

What is claimed is:

1. A voice synthesizing apparatus comprising:

sound source storage means for storing a plurality of sound data which includes at least sound data obtained from a sound of a musical instrument;

synthesis parameter generating means for generating a series of synthesis parameters defining phonemes from a series of character codes;

sound source generating means for selecting at least one sound data from the plurality of sound data stored in the sound source storage means, based on sound source information including at least data indicating the kind of musical instruments, and for generating a sound of a sound source based on the selected sound data; and synthesizing means for synthesizing a voice from the generated sound source according to the series of synthesis parameters.

2. A voice synthesizing apparatus according to claim 1, wherein said sound source storage means stores a plurality of kinds of sampled data obtained by sampling a waveform of at least one period from at least one kind of instrumental sound waveform.

3. A voice synthesizing apparatus according to claim 2, wherein the plurality of kinds of sampled data are stored in units of periods in said sound source storage means, with the amplitude power of each of the sampled data normalized in accordance with the input of a voice synthesizing filter.

4. A voice synthesizing apparatus according to claim 3, wherein the plurality of kinds of sampled data are stored in units of periods in said sound source storage means in bit-compressed form.

5. A voice synthesizing apparatus according to claim 1, wherein said sound source generating means comprises a plurality of instrumental sound generators and mixing means for summing outputs from said respective instrumental sound generators on the basis of information representing a mixing ratio.

6. An apparatus adapted for use as part of a voice synthesizing apparatus for synthesizing a voice comprising:

sound source generating means for generating a plurality of sounds forming voiced-sounds from a plurality of sound sources including at least a sound source obtained from sounds of at least a musical instrument;

sound source selecting means for selecting at least one of said plurality of sound sources; and instructing means for instructing the selection of said sound source selecting means.

7. An apparatus according to claim 6, wherein said plurality of sound sources are obtained from sounds of musical instruments.

8. An apparatus according to claim 6, wherein said sound source generating means has a plurality of kinds of sampled data obtained by sampling a waveform of at least one period from at least one kind of instrumental sound waveform.

9. An apparatus according to claim 8, further comprising a memory, wherein the plurality of kinds of sampled data are stored in units of periods in said memory, with the amplitude power of each of the sampled data normalized in accordance with the input of a voice synthesizing filter.

10. An apparatus according to claim 9, wherein the plurality of kinds of sampled data are stored in units of periods in said memory in bit-compressed form.

11. An apparatus according to claim 6, wherein said sound source generating means comprises a plurality of instrumental sound generators and mixing means for summing outputs from said respective instrumental sound generators on the basis of information representing a mixing ratio.

12. An apparatus adapted for use as part of a voice synthesizing apparatus for synthesizing a voice, comprising:

a memory for storing voice information for a predetermined period, including information of the type of sound source used to generate sounds forming voiced-sounds for synthesizing the voice, a filter factor used by the synthesizing filter for synthesizing the voice, and information indicating whether the sound source to be used to generate the sounds for synthesizing the voice is obtained from instrumental sounds or from human voices.

13. An apparatus according to claim 12, wherein said instrumental sound source having a plurality of kinds of sampled data obtained by sampling a waveform of at least one period form at least one kind of instrumental sound waveform.

14. An apparatus according to claim 13, wherein the plurality of kinds of sampled data stored in units of periods are stored in said memory, with the amplitude power of each of the sampled data normalized in accordance with the input of a voice synthesizing filter.

15. An apparatus according to claim 14, wherein the plurality of kinds of sampled data are stored in units of periods in said memory in bit-compressed form.

16. An apparatus according to claim 12, wherein said instrumental sound source comprises a plurality of instrumental sound generators and mixing means for summing outputs from said respective instrumental sound generators on the basis of information representing a mixing ratio.

17. A method of synthesizing a voice comprising the steps of:

generating a series of synthesis parameters from a series of character codes;

selecting at least one sound data from a plurality of sound data including at least sound data obtained form sounds of a musical instrument stored in sound source storage means, based on sound source information including at least data indicating a kind of musical instruments;

generating a sound of a source based on the selected sound data; and synthesizing a voice from the generated sound source according to the series of synthesis parameters.

18. A method according to claim 17, further comprising the step of obtaining the sound source information which comprises a plurality of kinds of sampled data, by sampling a waveform of at least one period from at least one kind of instrumental sound waveform.

19. A method according to claim 18, wherein said sound source information obtaining step includes the step of normalizing an amplitude power of each of the plurality of kinds of sampled data in accordance with the input of a voice synthesizing filter.

20. A method according to claim 18, wherein said sound source information obtaining step includes the step of bit-compressing the plurality of kinds of sampled data.

21. A method according to claim 17, further comprising the step of designating a mixing ratio with which a plurality of instrumental sounds are mixed and wherein said sound generating step comprises the step of summing the plurality of instrumental sounds on the basis of the mixing ratio.

22. A method used as a part of a method of synthesizing a voice comprising the steps of:

generating a plurality of sounds forming voiced-sounds from a plurality of sound sources including at least a sound source obtained from sounds of at least a sound source obtained from sounds of at least a musical instrument;

instructing a selection from the plurality of sound sources; and selecting at least one of the plurality of sound sources according to said instructing step.

23. A method according to claim 22, wherein said plurality of sound sources are obtained from sounds of musical instruments.

24. A method according to claim 22, wherein the sound information comprises a plurality of kinds of sampled data, wherein said method further comprises the step of obtaining the sounds, by sampling a waveform of at least one period from at least one kind of instrumental sound waveform.

25. A method according to claim 24, wherein said obtaining step includes the step of normalizing an amplitude power of each of the plurality of kinds of sampled data in accordance with the input of a voice synthesizing filter.

26. A method according to claim 25, wherein said obtaining step includes the step of bit-compressing the plurality of kinds of sampled data.

27. A method according to claim 22, further comprising the step of designating a mixing ratio with which a plurality of instrumental sounds are mixed and wherein said generating step comprises the step of summing the plurality of instrumental sounds on the basis of the mixing ratio.

28. A method of synthesizing a voice based on voice information for a predetermined interval, comprising the steps of:

preparing and storing in a memory the voice information which includes information of the type of sound source used to generate sounds forming voiced-sounds for synthesizing the voice, a filter factor used by a synthesizing filter for synthesizing the voice, and information indicating whether the sound source to be used to generate the sound for synthesizing the voice is an instrumental sound source or a human voice sound source; and synthesizing the voice according to the voice information.

29. A method according to claim 28, further comprising the step of generating sound information comprising a plurality of kinds of sampled data, by sampling a waveform of at least one period from at least one kind of instrumental sound waveform, the sound information being used by the sound source to generate the sound for synthesizing the voice.

30. A method according to claim 29, wherein said preparing and storing step includes the step of normalizing an amplitude power of each of the plurality of kinds of sampled data in accordance with the input of a voice synthesizing filter.

31. A method according to claim 30, wherein said preparing and storing step includes the step of bit-compressing the plurality of kinds of sampled data.

32. A method according to claim 28, further comprising the steps of designating a mixing ratio with which a plurality of instrumental sounds are mixed, and generating the sound generated by summing the plurality of instrumental sounds on the basis of the mixing ratio.

* * * * *

UNITED STATES PATENT AND TRADEMARK OFFICE

CERTIFICATE OF CORRECTION

PATENT NO. : 5,321,794

DATED : June 14, 1994

INVENTOR(S) : JUNICHI TAMURA

It is certified that error appears in the above-indentified patent and that said Letters Patent is hereby corrected as shown below:

ON THE TITLE PAGE

ITEM [30] FOREIGN APPLICATION PRIORITY DATA

"Jan. 1, 1989 [JP] Japan ..... 1-19853" should read --January 31, 1989 [JP] Japan ..... 1-19853--.

COLUMN 2

Line 36, "phonetic the" should read --the phonetic--.

COLUMN 3

Line 24, "according present" should read --according to present--.

UNITED STATES PATENT AND TRADEMARK OFFICE

CERTIFICATE OF CORRECTION

PATENT NO. : 5,321,794

DATED : June 14, 1994

INVENTOR(S) : JUNICHI TAMURA

It is certified that error appears in the above-indentified patent and that said Letters Patent is hereby corrected as shown below:

COLUMN 8

Line 5, "having" should read --includes--.
Line 7, "form" should read --from--.
Line 29, "form" should read --from--.

Signed and Sealed this

Twenty-fifth Day of October, 1994

*Attest:*

*Attesting Officer*

BRUCE LEHMAN

*Commissioner of Patents and Trademarks*